United States Patent [19]

Verdi

[11] Patent Number: 4,780,971

[45] Date of Patent: Nov. 1, 1988

[54] TOE LEVELER FOR A SKI BOOT

[76] Inventor: William A. Verdi, 149-04 115th St., South Ozone Park, N.Y. 11420

[21] Appl. No.: 14,006

[22] Filed: Feb. 12, 1987

[51] Int. Cl.[4] ..... A43B 5/04; A43C 15/09

[52] U.S. Cl. ..... 36/132; 36/117

[58] Field of Search ..... 36/117, 132, 118–121, 36/1, 136

[56] References Cited

U.S. PATENT DOCUMENTS

| | | | |
|---|---|---|---|
| 4,155,179 | 5/1979 | Weninger | 36/117 |
| 4,194,309 | 3/1980 | Kastinger | 36/117 |

FOREIGN PATENT DOCUMENTS

| | | | |
|---|---|---|---|
| 2424875 | 12/1975 | Fed. Rep. of Germany | 36/132 |
| 2652654 | 5/1978 | Fed. Rep. of Germany | 36/132 |
| 2073260 | 10/1971 | France | 36/117 |
| 2152355 | 8/1985 | United Kingdom | 36/117 |

*Primary Examiner*—James Kee Chi

*Attorney, Agent, or Firm*—Michael I. Kroll

[57] ABSTRACT

A toe leveler for a ski boot is provided and consists of a body member slideably attached to toe portion of the ski boot. The body member is of a predetermined thickness to compensate for angular displacement of the ski boot. When the body member is placed under the toe portion the ski boot can be used to walk upon a flat surface keeping the leg of the skier straight.

3 Claims, 1 Drawing Sheet

TOE LEVELER FOR A SKI BOOT

BACKGROUND OF THE INVENTION

1. Field of the Invention

The instant invention relates generally to ski boots and more specifically it relates to a toe leveler for a ski boot.

2. Description of the Prior Art

Numerous ski boots have been provided in prior art that are adapted to angle the legs so that skiers will lean forward when skiing. When the skiers are on flat surfaces with their skies removed it is difficult to walk because of the angle of the legs. While these units may be suitable for the particular purpose to which they address, they would not be as suitable for the purposes of the present invention as heretofore described.

SUMMARY OF THE INVENTION

A primary object of the present invention is to provide a toe leveler for a ski boot that will overcome the shortcomings of the prior art devices.

Another object is to provide a toe leveler for a ski boot that will even out the angle of the boot making it easy to walk naturally and reduce liability of injury occuring while wearing the ski boot.

An additional object is to provide a toe leveler for a ski boot that can be attached to the toe portion of the boot and be placed in either a stored position on top of the boot when skiing or slide down to an extended position to be used for walking on a flat surface without the skis.

A further object is to provide a toe leveler for a ski boot that is simple and easy to use.

A still further object is to provide a toe leveler for a ski boot that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
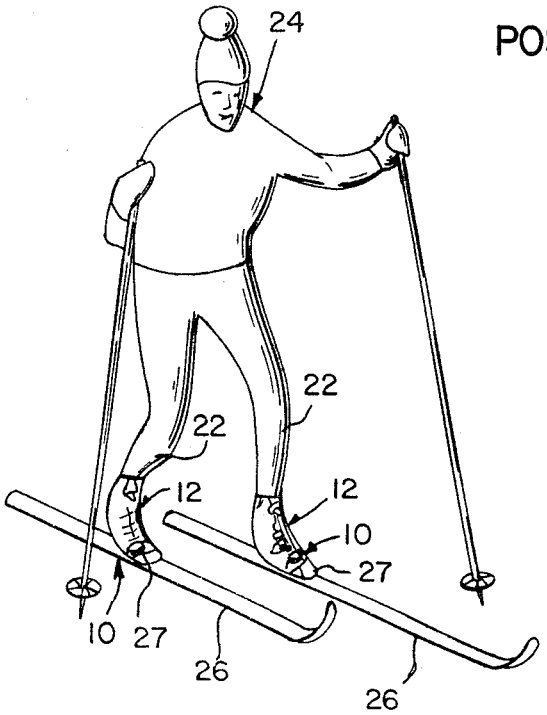
FIG. 1 is a perspective view of a skier with ski boots connected to skis and toe levelers in a retracted position.
Figure 2:
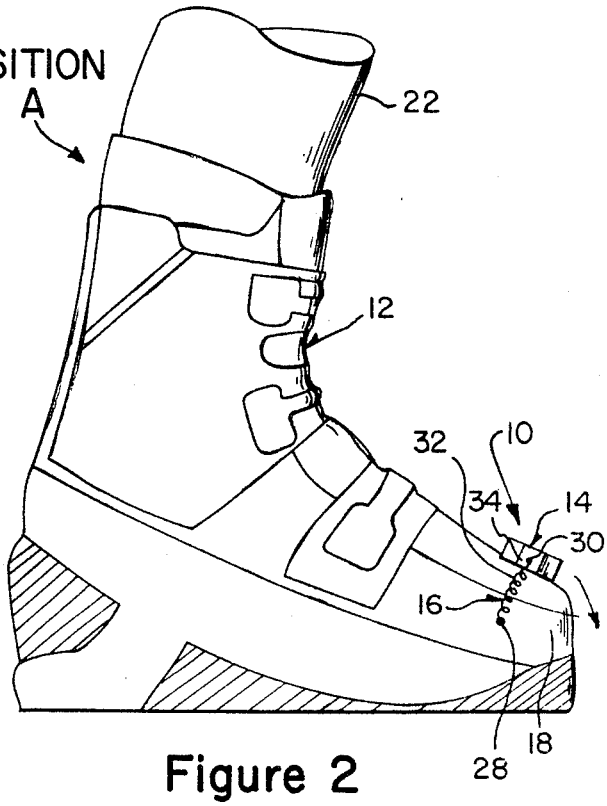
FIG. 2 is a side view of a ski boot with invention in the retracted position.
Figure 3:
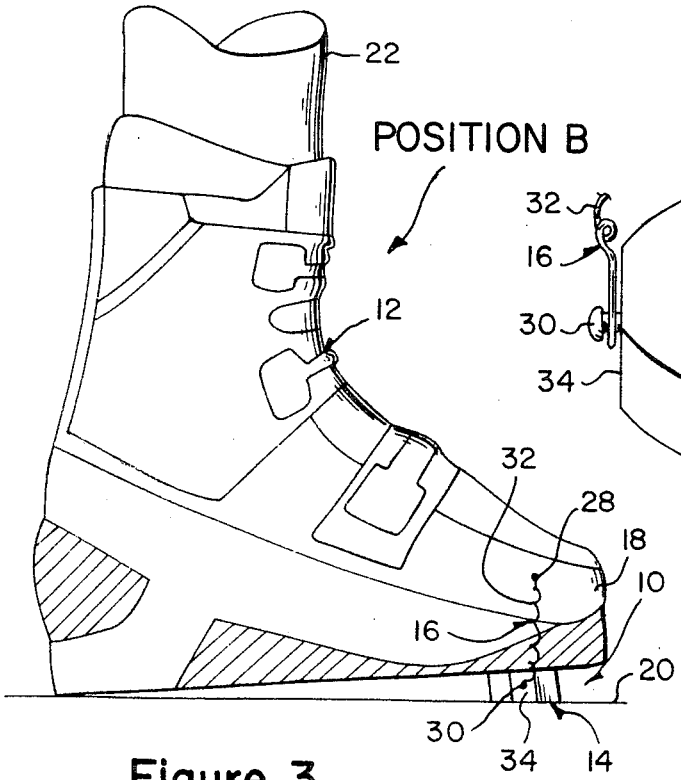
FIG. 3 is a side view of the ski boot on a flat surface with the invention in an extended position.

Turning now descriptively to the drawings, in which similar reference characters denote similar elements throughout the several views, FIGS. 1 through 4 illustrates a toe leveler 10 for a ski boot 12 and consists of a body member 14 and device 16 for attaching the body member to toe portion 18 of the ski boot 12. The body member 14 is of a predetermined thickness to compensate for angular displacement of the ski boot 12 when the ski boot is placed upon a flat surface 20 such as the ground or the like. The body member 14 is placed under the toe portion 18 of the ski boot 12, thus keeping leg 22 of the skier 24 straight. The attaching device 16 as shown in FIG. 2, position "A", stores the body member 14 upon top of the toe portion 18 whereby the ski boot 12 can then be attached to a ski 26 by the standard binding mechanism 27 (see FIG. 1). The attaching device 16 as shown in FIG. 3, position "B", will extend allowing the body member 14 to go under the toe portion 18 so that the ski boot l2 can be used for walking upon the flat surface 20.

The attaching device 16 includes a first pair of pins 28, a second pair of pins 30 and a pair of springs 32. Each of the first pins 28 is attached to one side of the toe portion 18 of the ski boot while each of the second pins 30 is attached to one end 34 of the body member 14. Each of the springs 32 has one end attached to one of the first pins 28 and has other end attached to one of the second pins 30 so that the body member 14 can slide upon the toe portion 18 of the ski boot 12 between the stored position "A" and the extended position "B".

The body member 14 is fabricated out of any durable material, such as wood, plastic, metal, etc., so as to support some of the weight coming from the toe portion 18 of the ski boot 12. The springs 32 are fabricated out of stretchable metal material so as to expand when the body member 14 slides upon the toe portion 18. The pins 28 can be integrally part of a new ski boot 12 when being manufactured or can be assembled to an existing ski boot 12 so that the toe leveler 10 can be utilized thereto. It is understood that the skier 24 will use two toe levelers 10, one on each ski boot 12 when either skiing or walking upon the flat surface 20.

Figure 4:
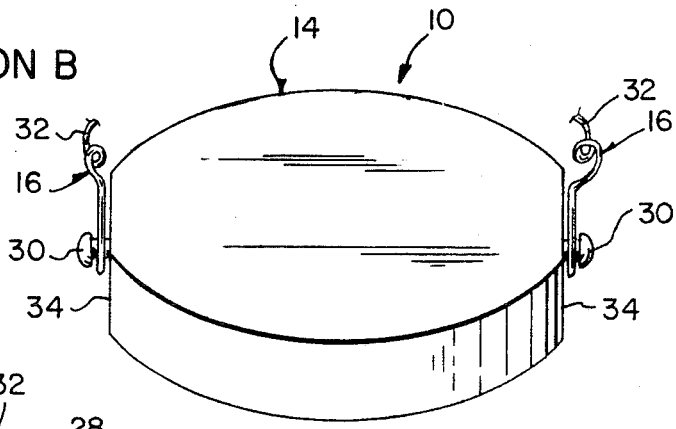
FIG. 4 is an enlarged perspective view of just the toe leveler in greater detail.
Figure 5:
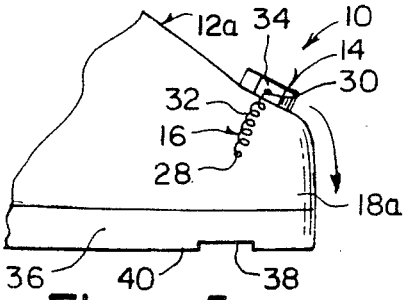
FIG. 5 is a side view with parts broken away of a modification in the retracted position.

FIG. 5 shows a modification in which a sole 36 is provided having an indent 38 in underside 40 thereof. The sole 36 is affixed to ski boot **12*a* so that the indent 38 is below toe portion 18*a* of the ski boot. The body member 14 and attaching device 16 is the same as shown in FIGS. 2, 3 and 4. When the attaching device 16 is in the extended position the body member 14 is placed under to toe portion 18*a* and into the indent 38 of the sole 36 so that the ski boot 12*a*** can be used for walking upon the flat surface thus keeping leg of skier straight.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A toe leveler for a ski boot having a toe portion with a top, comprising:

(a) a sole having an indent in underside thereof, said sole affixed to the ski boot so that said indent is below the toe portion of the ski boot;

(b) a body member mounted to the toe portion of the ski boot and being of a predetermined thickness and movable from a first position on the top of the toe portion of the ski boot; and (c) spring means for attaching said body member to the toe portion of the ski boot in an infinite number of places so as to compensate for ski boots with different widths so that in said first position said body member is stored upon the top of the toe portion allowing the ski boot to be attached to a ski and in said second position said body member is placed under the toe portion and into said indent of said sole so that said body member is prevented from involuntary movement and the angular displacement of the ski boot is compensated for when the ski boot is placed on a flat surface without the ski and keeping leg of skier straight and allowing the ski boot to be used for walking upon the flat surface.

2. A toe leveler as recited in claim 1, wherein said attaching means includes:

(a) a first pair of pins, each of which is attached to one side of the toe portion of the ski boot;

(b) a second pair of pins, each of which is attached to one end of the body member; and (c) a pair of springs, each of which having one end attached to first pair of pins and having other end attached to one of said second pair of pins so that said body member can slide upon the toe portion of the ski boot between the stored position and the extended position.

3. A toe leveler as recited in claim 2, further comprising;

(a) said body member fabricated out of durable material so as to support some of the weight coming from the toe portion of the ski boot; and (b) said springs fabricated out of stretchable metal material so as to expend when said body member slides upon the toe portion.

* * * * *